US005954274A

United States Patent [19]

Sumida et al.

[11] Patent Number: 5,954,274

[45] Date of Patent: Sep. 21, 1999

[54] CYLINDER INJECTION TYPE FUEL INJECTION VALVE

[75] Inventors: Mamoru Sumida; Norihisa Fukutomi, both of Tokyo; Tsuyoshi Munezane, Kobe, all of Japan

[73] Assignee: Mitsubishi Denki Kabushiki Kaisha, Tokyo, Japan

[21] Appl. No.: 08/870,738

[22] Filed: Jun. 6, 1997

[30] Foreign Application Priority Data

Jul. 29, 1996 [JP] Japan ..... 8-198853

[51] Int. Cl.[6] ..... F02M 61/00

[52] U.S. Cl. ..... 239/533.12; 239/473; 239/585.4; 239/585.5

[58] Field of Search ..... 239/463, 487, 239/533.2, 533.9, 533.11, 533.12, 585.1, 585.4, 585.5, 472, 473, 477, 478

[56] References Cited

U.S. PATENT DOCUMENTS

| | | | |
|---|---|---|---|
| 4,946,132 | 8/1990 | Reiter | 239/585.4 X |
| 4,971,254 | 11/1990 | Daly et al. | 239/487 X |
| 5,108,037 | 4/1992 | Okamoto et al. | 239/533.12 X |
| 5,207,384 | 5/1993 | Horsting | 239/463 |
| 5,341,994 | 8/1994 | Wakeman | 239/585.5 |
| 5,678,767 | 10/1997 | Rahbar | 239/533.2 |

FOREIGN PATENT DOCUMENTS 2-215963 8/1990 Japan .

*Primary Examiner*—Andres Kashnikow
*Assistant Examiner*—Steven J. Ganey
*Attorney, Agent, or Firm*—Sughrue, Mion, Zinn, Macpeak & Seas, PLLC

[57] ABSTRACT

A cylinder injection type fuel injection valve comprising: a valve body of a cylindrical type; a valve seat having at the center thereof an injection nozzle for injecting fuel; a valve capable of contacting to and separating from the valve seat to open and closing the injection nozzle; a swirler having a substantially cylindrical shape which causes a swirl motion in the fuel flowing into the injection nozzle of the valve seat, and which is located around the valve to support the valve so that the valve is slidably moved therein; a hollow housing having one end connected to the valve body and the other end connectable to a fuel supply tube; and a solenoid located in the inside of the housing to operate the valve to be opened and closed, wherein a clearance between the inner diameter of the swirler and the outer diameter of the valve is set to be a half or less of a lifting distance of the valve, whereby a deviation between the valve seat and the valve at a time of a valve-opening state is controlled to be a half or less of the lifting distance at most so that nonuniformity of atomization is suppressed.

19 Claims, 5 Drawing Sheets

PRIOR ART

CYLINDER INJECTION TYPE FUEL INJECTION VALVE

BACKGROUND OF THE INVENTION

1. Field of the Invention

The present invention relates to a cylinder injection type fuel injection valve which is attached to a cylinder head in order to inject fuel directly into a combustion chamber of a combustion engine.

2. Discussion of Background

FIG. 8 is a side view in cross section of a conventional fuel injection valve shown, for example, in Japanese Unexamined Patent Publication JP-A-2- 215963 (a year of 1990). In the Figure, a reference numeral 21 designates a yoke which constitutes an injection valve body in which a coil unit 24 having a core 22, an electromagnetic coil 23 and so on is fixedly installed. A reference numeral 25 designates a plunger. A ring 26 is connected to an end of the plunger and a rod 27 is connected to the other end thereof integrally by a technique such as a connection method using plastic flow, welding or press-fitting. Further a spherical valve 28 is welded to the tip of the rod 27 to be integrally connected. The plunger 25 is inserted in a fuel passage 29 formed in the center of the yoke 21 along the axis direction of the yoke and arranged in the same direction as that of the core 22. A part of the ring 26 is inserted in an inner periphery of one end of the core 22 such that the core 22 is slidable. A return spring 31 is interposed between the plunger 25 and a spring force adjuster 30 screwed in the core 22.

A nozzle 32 is attached to the bottom end of the yoke 21. The nozzle 32 in a cylindrical shape is formed such that a valve seat 33 is formed in an inner portion; a fuel injection nozzle 34 is provided in the downstream side of the valve seat 33; and an element generating swirling force in fuel 35 is fixedly provided on the upstream side of the valve seat 33.

The element generating swirling force in fuel 35 has an annular body portion having a top-like shape. The spherical valve 28 is inserted in the inner diameter portion (inner periphery) of the annular portion so that the spherical valve is guided to be able to move reciprocally in the axis direction. A reference numeral 36 designates a stopper for controlling a moving distance of the spherical valve 28 which is arranged on the top portion of the nozzle 32. A reference numeral 37 designates a fuel supplying port formed in the yoke 21 and a reference numeral 38 designates a connector.

Next, explanation will be given of the operation. The electromagnetic coil 23 is controlled by applying signals of ON and OFF through the connector 38 according to a predetermined duty whereby the electromagnetic coil 23 is excited or deenergized. When the electromagnetic coil 23 is excited, the coil 23, the core 22, the yoke 21 and the plunger 25 form a magnetic circuit, and the plunger 25 and the spherical valve 28 are magnetically attracted on the side of the core 22 simultaneously. Accordingly, a flow passage in an annular shape (minute space) is kept between the spherical valve 28 and the valve seat 33 in a valve-open state.

However, in the conventional fuel injection valve constructed as described in the above, there were drawbacks such that a performance of combustion is largely influenced by ununiformity of fuel atomization caused when fuel is directly injected into the cylinder.

SUMMARY OF THE INVENTION

It is an object of the present invention to solve the above problems, namely, to remove nonuniformity of fuel atomization caused by a fuel injection, to prevent contaminants from invading into a guide portion, and to improve sealing performance of valve.

According to a first aspect of the present invention, there is provided a cylinder injection type fuel injection valve comprising: a valve body of a cylindrical type; a valve seat having at the center thereof an injection nozzle for injecting fuel; a valve capable of contacting to and separating from the valve seat to open and close the injection nozzle; a swirler having a substantially cylindrical shape which causes a swirl motion in the fuel flowing into the injection nozzle of the valve seat, which is located around the valve to support the valve so that the valve is slidably moved therein; a hollow housing having one end connected to the valve body and the other end connectable to a fuel supply tube; and a solenoid located in the inside of the housing to operate the valve to be opened and closed, wherein said cylinder injection type fuel injection valve being characterized in that a clearance between the inner diameter of the swirler and the outer diameter of the valve is set to be a half or less of a lifting distance of the valve.

According to a second aspect of the present invention, there is provided a cylinder injection type fuel injection valve according to the first aspect of the invention, wherein a length of a portion where the valve is in contact with the swirler in sliding is set to be longer than the inner diameter of the swirler.

According to a third aspect of the present invention, there is provided a cylinder injection type fuel injection valve according to the first aspect, wherein an amount of clearance between the outer diameter of the swirler and the inner diameter of the valve is set to be a half or less of a lift distance of the valve.

According to a fourth aspect of the present invention, there is provided a cylinder injection type fuel injection valve according to the first aspect, wherein the outer diameter of the valve seat is larger than the inner diameter of the valve body by several $\mu$m in order to provide an interference for press-fitting; and the valve seat is penetrated into the inner diameter portion of the valve body with the several $\mu$m of interference so that the outer diameter of the valve seat fits into the inner diameter of the valve body.

According to a fifth aspect of the present invention, there is provided a cylinder injection type fuel injection valve according to the first aspect, wherein the swirler and the valve are arranged so that the inner diameter of the swirler and the outer diameter of the valve are not in contact when the valve in an open state.

According to a sixth aspect of the present invention, there is provided a cylinder injection type fuel injection valve according to the first aspect, wherein the swirler and the valve are arranged so that the outer diameter of the valve guides the valve in association with the inner diameter of the swirler.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

A detailed explanation will be given to Preferred Embodiments of the present invention in reference to FIGS. 1 through 7 as follows.

EMBODIMENT 1

Figure 1:
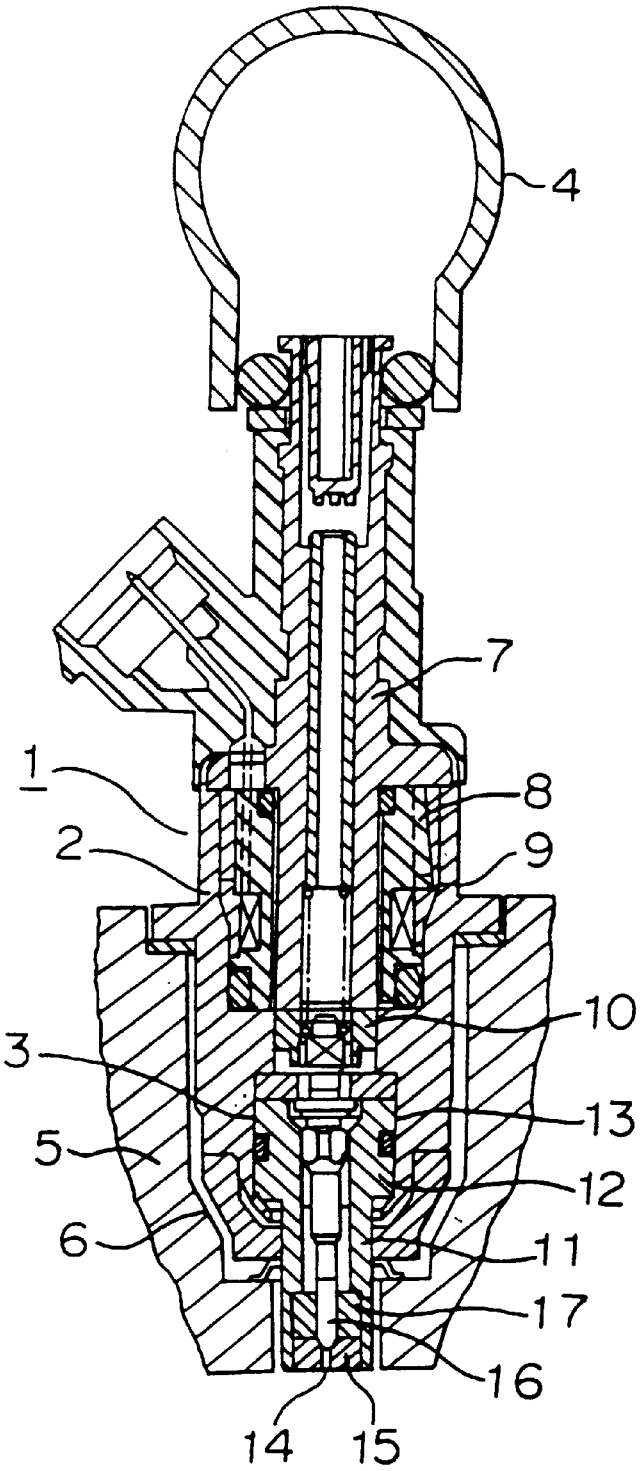
FIG. 1 is a side view in cross section of a cylinder injection type fuel injection valve according to an Embodiment of the present invention.

FIG. 1 is a side view in cross section of a cylinder injection type fuel injection valve 1 according to an embodiment of the present invention. In FIG. 1, the cylinder injection type fuel injection valve 1 comprises a housing 2 and a valve device 3 supported in an end (the bottom end in the drawing) of the housing 2 by a connection means such as calking. The tip of the fuel injection valve 1 is inserted and in a sealing state to an insertion hole 6 in a cylinder head 5 of combustion engine. The other end (the top end in the drawing) of the housing 2 is connected to a fuel supplying tube 4. A reference numeral 7 designates a core; a reference numeral 8 designates a coil assembly; a reference numeral 9 designates a coil; and a reference numeral 10 designates an armature.

The valve device 3 comprises a valve body 13 in a cylindrical shape with a stepped portion having a cylindrical portion of small diameter 11 and a cylindrical portion of large diameter 12, a valve seat 15 having a fuel injection nozzle 14, which is fixed to a tip portion of a center hole of the valve body 13, a needle valve 16 operated by a solenoid device to open and to close the fuel injection nozzle 14 in association with the valve seat 15, and a swirler 17 for guiding the needle valve 16 in the axial direction thereof and for providing a swirling motion to a fuel which is to flow inwardly in a radial direction into the fuel injection nozzle 14 of the valve seat 15. The valve body 13 of the valve device 3 constitutes a housing of the cylinder injection type fuel injection valve 1 together with the housing 2.

Figure 2:
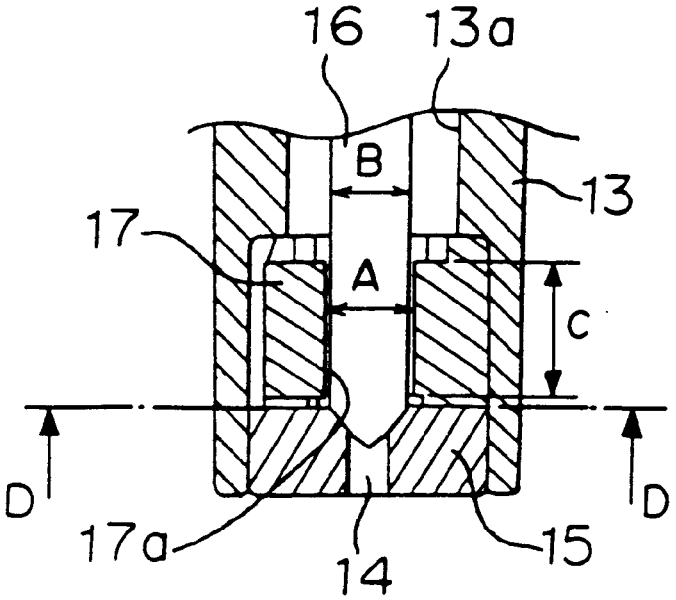
FIG. 2 is an enlarged cross-sectional view showing a tip portion of a valve according to an Embodiment of the present invention.
Figure 3:
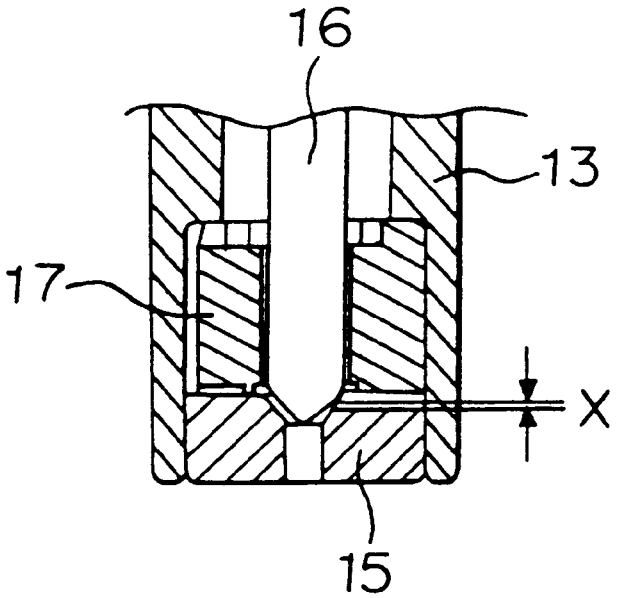
FIG. 3 is an enlarged cross-sectional view showing a tip portion of a valve according to an Embodiment of the present invention.

FIGS. 2 and 3 are enlarged cross-sectional views showing a tip portion of a needle valve 16 respectively in a closing state and in an opening state. In the Figures, a reference numeral 13 a designates an inner diameter portion of a valve body 13, and a reference numeral 17 a designates an inner diameter portion of a swirler 17.

Explanation will be given of the operation of thus constructed fuel injection valve. When the coil 9 is applied with electricity, a magnetic circuit composed of the armature 10, the core 7 and the housing 2 generates a magnetic flux, whereby the armature 10 is attracted to and moved on the side of the core 7. The needle valve 16 integrally constructed with the armature 10 is slid on the upward direction guided by the inner peripheral portion 17*a* of the swirler 17, whereby a space appears between the needle valve 16 and the valve seat 15 in accordance with the separation of the needle valve 16 and the valve seat 15. Then, a highly pressured fuel passes from the valve body 13 to the swirler 17, where the fuel is provided with a swirly flow. The swirly flow of fuel enters in the injection nozzle 14 of the valve seat 15 and atomized at the outlet of the injection nozzle.

In FIGS. 2 and 3, in a case that a relation of $A-B \leqq X/2$ is set, where A designates the inner diameter of the swirler 17; B designates the outer diameter of the needle valve 16; and X designates the lifting distance of the needle valve 16, an amount of eccentricity of the needle valve with respect to the valve seat 15 in an opening state is controlled to be X/2 at most, whereby unevenness of the atomization can be suppressed.

Figure 4:
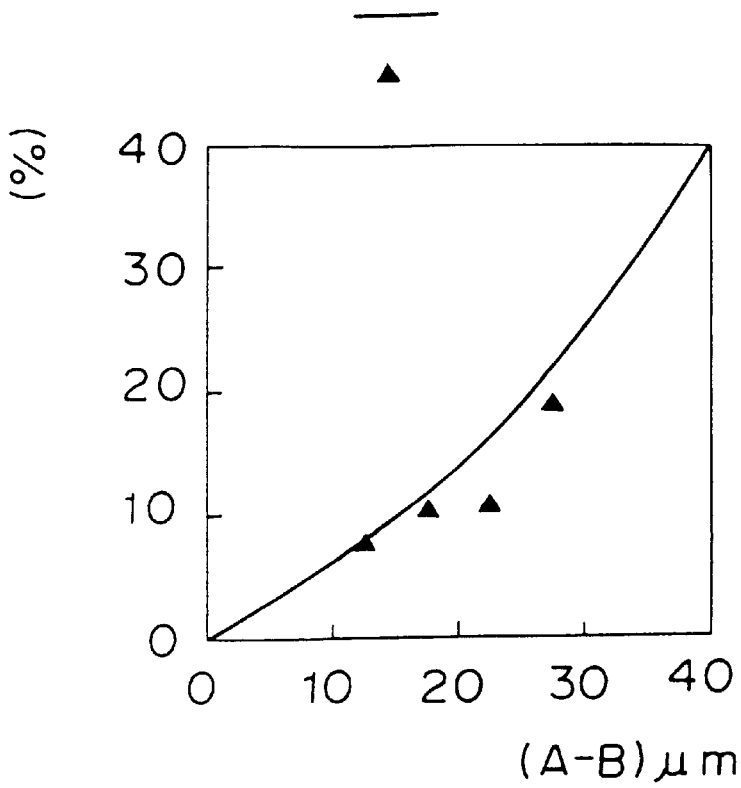
FIG. 4 is a diagram showing a relation of clearances between the inner diameter of a swirler and the outer diameter of a needle valve to error rates of flowing amount according to an Embodiment 1 of the present invention.
Figure 5:
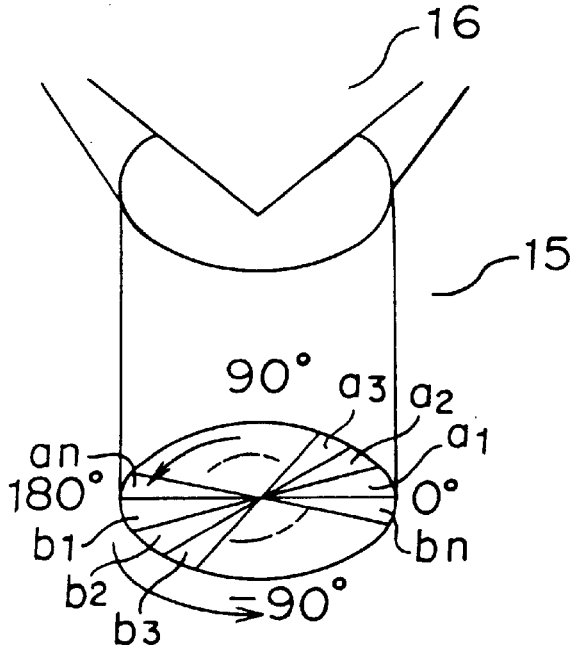
FIG. 5 is a perspective view for schematically showing a tip portion of a valve according to an Embodiment 1 of the present invention.

In FIG. 4, a relation between clearances (A−B) and error rates of flow quantity (index of degree of ununiformity of atomized fuel) is shown based on results of analysis and results of actual measurement when the needle valve lifting distance X is 60 $\mu$m. How the results of analysis of the error rates of flow quantity is obtained will be explained in the followings. In FIG. 5, a diametrically divided half portion in a horizontal plane of the injection nozzle 14 in a horizontal section is divided evenly into $a_1, a_2, a_3, \ldots a_n$ and the other half portion is also divided evenly into n elements of $b_1, b_2, b_3, \ldots b_n$. When symbols of $Qa_1, Qa_2, Qa_3, \ldots Qa_n$ represent flow quantities passing through the portions of $a_1, a_2, a_3, \ldots a_n$ and symbols of $Qb_1, Qb_2, Qb_3, \ldots Qb_n$ represent the quantities passing through the portions of $b_1, b_2, b_3, \ldots b_n$, error rates of flow can be obtained by the following formula.

(Formula 1)

$$E = \frac{(Qa_1 - Qb_1) + (Qa_2 - Qb_2) + (Qa_3 - Qb_3) + \cdots + (Qa_n - Qb_n)}{Qa_1 + Qa_2 + Qa_3 + \cdots + Qa_n + Qb_1 + Qb_2 + Qb_3 + \cdots + Qb_n} = \frac{\sum_{k=1}^{n} (Qa_k - Qb_k)}{Q} \times 100\ (\%)$$

Q: Total quantity of flow

As shown in FIG. 4, in a case that the needle valve lifting distance X is 60 $\mu$m, the nonuniformity of atomization of fuel increases abruptly in a clearance (A−B) of about 30 $\mu$m or more.

EMBODIMENT 2

A cylinder injection type fuel injection valve is constituted in the same manner as in the above provided that a relation of $C \geqq A$ is satisfied as shown in FIG. 2, where C designates a length of a clearance portion between the inner diameter of the swirler 17 and the outer diameter of the needle valve 16 which are in a sliding condition and A designates the inner diameter of the swirler 17. With such construction, invasion of contaminants can be prevented.

EMBODIMENT 3

Figure 6:
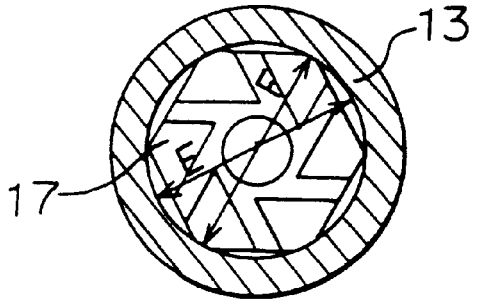
FIG. 6 is a cross-sectional view taken along a line D—D in FIG. 2.

FIG. 6 is a cross-sectional view taken along a line D—D in FIG. 2. In FIG. 6, it is so constituted that a relation of $E-F \leqq X/2$ is satisfied, where E designates the inner diameter of the valve body 13 and F designates the outer diameter of the swirler 17. The reason why the relation $E-F \leqq X/2$ is necessary for a proper seating of the needle valve 16 is the relation of $A-B \leqq X/2$ is already set in Example 1.

EMBODIMENT 4

The outer diameter of a valve seat 15 is larger than the inner diameter of a valve body 13 by several μm in order to provide an interference for press-fitting. The valve seat 15 is press-fitted into the inner diameter portion of the valve body 13 with difference of several μm. A concetricity between the valve seat 15 and the valve body 13 is obtainable by providing such structure.

EMBODIMENT 5

Figure 7:
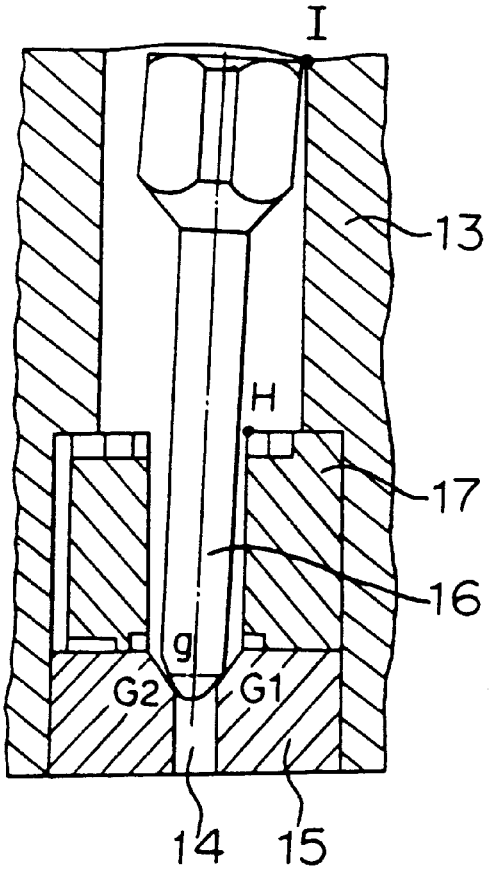
FIG. 7 is an enlarged cross-sectional view showing a tip portion of a needle valve according to an Embodiment 5 of the present invention.
Figure 8:
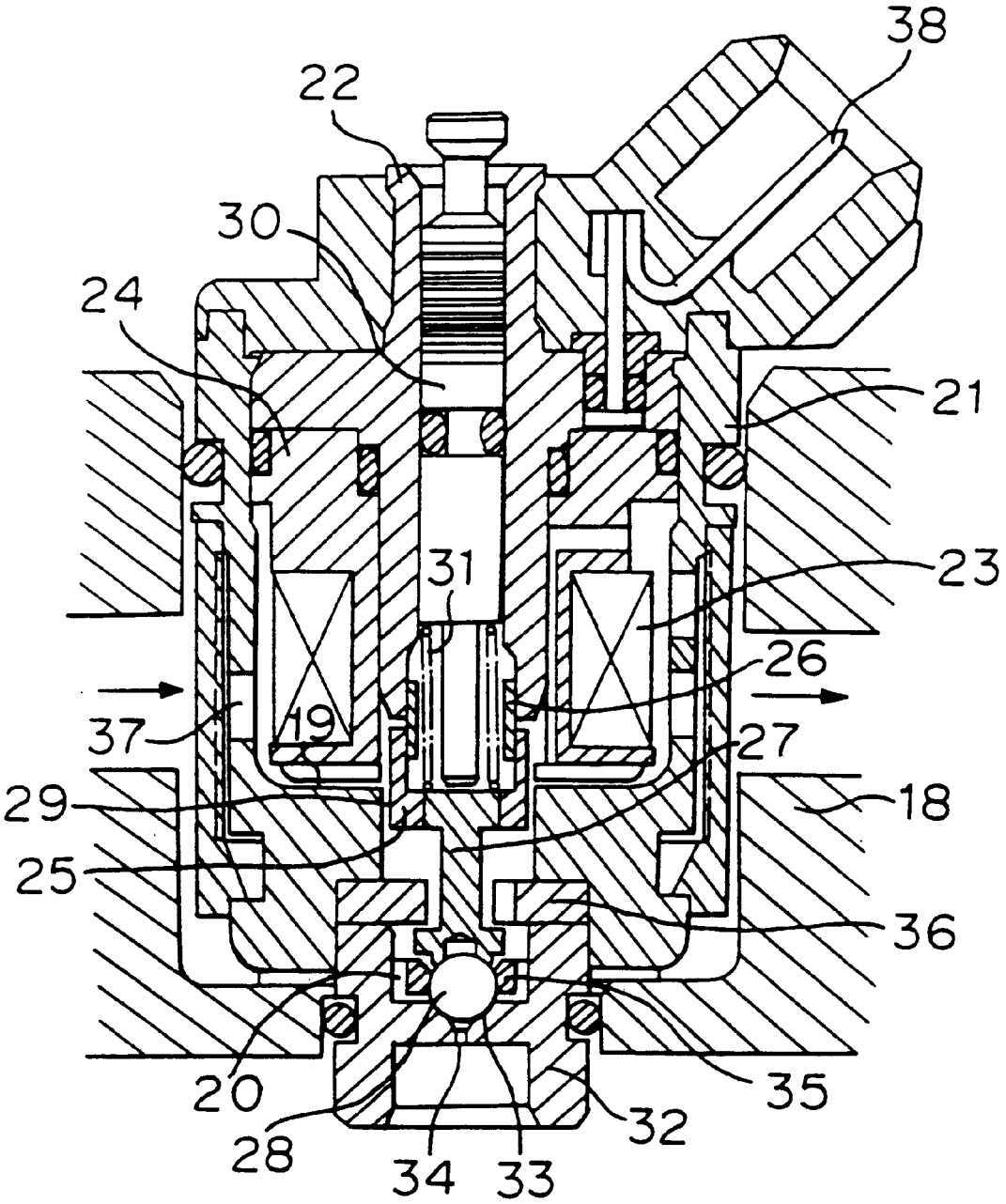
FIG. 8 is a side view in cross section showing a conventional fuel injection valve.

Construction is so made that the inner diameter of a swirler 17 and the outer diameter of the needle valve 16 do not contact when a needle valve 16 is seated. FIG. 7 is an enlarged cross-sectional view showing a tip portion of the needle valve, wherein $G_1$, $G_2$ are contact points of the needle valve 16 with the valve seat 15; and g designates a point at which the center line of the needle valve 16 and a line $G_1$–$G_2$ intersect. As shown in FIG. 7, when the needle valve 16 is rotated around the line g, the needle valve comes in contact with a valve body 13 at a contact point of I before the needle valve comes in contact with the swirler at a point E. As described in the above, when the needle valve 16 is seated, the outer diameter of the needle valve 16 is not in contact with the inner diameter of the swirler 17, whereby the sealing of valve is improved.

EMBODIMENT 6

In Embodiment 5, the case that the needle valve 16 is seated is explained. In this Embodiment, it is constituted such that when a needle valve 16 is operated and is seated on the valve seat, the inner diameter of a swirler 17, and the outer diameter of the needle valve 16 guide the needle valve 16.

With such construction, an inclination of the needle valve 16 can be controlled, whereby a smooth operation of the needle valve 16 is obtainable.

As stated above, according to a cylinder injection type fuel injection valve of the first aspect of the present invention, nonuniformity of atomized fuel can be improved by providing a clearance between the inner diameter of a swirler and the outer diameter of a valve to be a half or less of a lifting distance of the valve.

Further, according to a cylinder injection type fuel injection valve of the second aspect of the present invention, invasion of contaminants can be prevented by providing a length of a sliding portion between a swirler and a valve to be larger than the inner diameter of the swirler.

Further, according to a cylinder injection type fuel injection valve of the third aspect of the present invention, a valve can be seated by providing a clearance between the outer diameter of a swirler and the inner diameter of a valve body to be a half or less of a lifting distance of a valve.

Further, according to a cylinder injection type fuel injection valve of the fourth aspect of the present invention, a concentricity between a valve seat and a valve body is obtainable when the outer diameter of a valve seat and the inner diameter of a valve body are fitted. This is achieved by providing an interference so that the outer diameter of the valve seat is several μm larger than the inner diameter of the valve body, whereby the valve seat is press-fitted into the inner diameter of the valve body with a difference of the diameters of several μm.

According to a cylinder injection type fuel injection valve of the fifth aspect of the present invention, a sealing performance of a valve can be improved since the inner diameter of a swirler and the outer diameter of a valve are not in contact when the valve is in an opening state.

Further, according to a cylinder injection type fuel injection valve of the sixth aspect of the present invention, an inclination of a valve can be controlled and an operation of the valve can be smoothed since the inner diameter of a swirler and the outer diameter of a valve guide the valve when the valve is in an opening state.

Obviously, numerous modifications and variations of the present invention are possible in light of the above teachings. It is therefore to be understood that within the scope of the appended claims, the invention may be practiced otherwise than as specifically described herein.

What is claimed is:

1. A cylinder injection type fuel injection valve comprising:

a valve body of a cylindrical type;

a valve seat having at the center thereof an injection nozzle for injecting fuel;

a valve capable of contacting to and separating from the valve seat to open and close the injection nozzle;

a swirler having a substantially cylindrical shape which causes a swirl motion in the fuel flowing into the injection nozzle of the valve seat, and which is located around the valve to support the valve so that the valve is slidably moved therein;

a hollow housing having one end connected to the valve body and the other end connectable to a fuel supply tube; and a solenoid located in the inside of the housing to operate the valve to be opened and closed, wherein a clearance between an inner diameter of the swirler and an outer diameter of the valve is set to be a half or less of a lifting distance of the valve.

2. A cylinder injection type fuel injection valve according to claim 1, wherein an outer diameter of the valve seat and an inner diameter of the valve body are engaged by press-fitting.

3. A cylinder injection type fuel injection valve according to claim 2, wherein the inner diameter of the swirler and the outer diameter of the valve are not in contact at the time of a valve closing state.

4. A cylinder injection type fuel injection valve according to claim 2, wherein the inner diameter of the swirler and the outer diameter of the valve guide the valve at the time of a valve opening state.

5. A cylinder injection type fuel injection valve according to claim 1, wherein the inner diameter of the swirler and the outer diameter of the valve are not in contact at the time of a valve closing state.

6. A cylinder injection type fuel injection valve according to claim 5, wherein the inner diameter of the swirler and the outer diameter of the valve guide the valve at the time of a valve opening state.

7. A cylinder injection type fuel injection valve according to claim 1, wherein the inner diameter of the swirler and the outer diameter of the valve guide the valve at the time of a valve opening state.

8. A cylinder injection type fuel injection valve comprising:

a valve body of a cylindrical type;

a valve seat having at the center thereof an injection nozzle for injecting fuel;

a valve capable of contacting to and separating from the valve seat to open and closing the injection nozzle;

a swirler having a substantially cylindrical shape which causes a swirl motion in an fuel flowing into the injection nozzle of the valve seat, and which is located around the valve to support the valve so that the valve is slidably moved therein;

a hollow housing having one end connected to the valve body and the other end connectable to a fuel supply tube; and a solenoid located in the inside of the housing to operate the valve to be opened and closed, wherein a clearance between an inner diameter of the swirler and an outer diameter of the valve is set to be a half or less of a lifting distance of the valve, and a length of sliding portion between the swirler and the valve is set to be longer than the inner diameter of the swirler.

9. A cylinder injection type fuel injection valve according to claim 8, wherein a clearance between an outer diameter of the swirler and an inner diameter of the valve body is set to be a half or less of a lifting distance of the valve.

10. A cylinder injection type fuel injection valve according to claim 9, wherein an outer diameter of the valve seat and an inner diameter of the valve body are engaged by press-fitting.

11. A cylinder injection type fuel injection valve according to claim 9, wherein the inner diameter of the swirler and the outer diameter of the valve are not in contact at the time of a valve closing state.

12. A cylinder injection type fuel injection valve according to claim 9, wherein the inner diameter of the swirler and an outer diameter of the valve guide the valve at the time of a valve opening state.

13. A cylinder injection type fuel injection valve according to claim 8, wherein an outer diameter of the valve seat and an inner diameter of the valve body are engaged by press-fitting.

14. A cylinder injection type fuel injection valve according to claim 8, wherein the inner diameter of the swirler and the outer diameter of the valve are not in contact at the time of a valve closing state.

15. A cylinder injection type fuel injection valve according to claim 8, wherein the inner diameter of the swirler and an outer diameter of the valve guide the valve at the time of a valve opening state.

16. A cylinder injection type fuel injection valve comprising:

a valve body of a cylindrical type;

a valve seat having at the center thereof an injection nozzle for injecting fuel;

a valve capable of contacting to and separating from the valve seat to open and closing the injection nozzle;

a swirler having a substantially cylindrical shape which causes a swirl motion in the fuel flowing into the injection nozzle of the valve seat, and which is located around the valve to support the valve so that the valve is slidably moved therein;

a hollow housing having one end connected to the valve body and the other end connectable to a fuel supply tube; and a solenoid located in the inside of the housing to operate the valve to be opened and closed, wherein a clearance between an inner diameter of the swirler and an outer diameter of the valve is set to be a half or less of a lifting distance of the valve, and a clearance between an outer diameter of the swirler and an inner diameter of the valve body is set to be a half or less of a lifting distance of the valve.

17. A cylinder injection type fuel injection valve according to claim 16, wherein an outer diameter of the valve seat and an inner diameter of the valve body are engaged by press-fitting.

18. A cylinder injection type fuel injection valve according to claim 16, wherein the inner diameter of the swirler and the outer diameter of the valve are not in contact at the time of a valve closing state.

19. A cylinder injection type fuel injection valve according to claim 16, wherein the inner diameter of the swirler and an outer diameter of the valve guide the valve at the time of a valve opening state.

* * * * *